United States Patent [19]

Sutherland

[11] 4,046,483

[45] Sept. 6, 1977

[54] TROWELING MACHINE

[76] Inventor: John W. Sutherland, P.O. Box 5050, Jacksonville, Fla. 32207

[21] Appl. No.: 742,858

[22] Filed: Nov. 18, 1976

[51] Int. Cl.[2] ..... E01C 19/22

[52] U.S. Cl. ..... 404/112; 51/177

[58] Field of Search ..... 404/112; 15/235.4; 51/71, 177

[56] References Cited

U.S. PATENT DOCUMENTS

| | | | |
|---|---|---|---|
| 2,277,389 | 3/1942 | Conway | 404/112 |
| 2,504,259 | 4/1950 | Ford | 74/242.4 |
| 2,594,331 | 4/1952 | McCrery | 404/112 |
| 2,667,824 | 2/1954 | McCrery | 404/112 |
| 2,887,934 | 5/1959 | Whiteman | 404/112 |
| 2,888,863 | 6/1959 | Eisenbeis | 404/112 |
| 2,979,996 | 4/1961 | Spitler | 404/112 |
| 3,296,946 | 1/1967 | Cagno | 404/112 |
| 3,361,044 | 1/1968 | Wolf | 404/112 |
| 3,375,766 | 4/1968 | Zochil | 404/112 X |
| 3,402,647 | 9/1968 | Colizza | 404/112 X |
| 3,412,657 | 11/1968 | Colizza | 404/112 |

*Primary Examiner*—Nile C. Byers Jr.

*Attorney, Agent, or Firm*—George H. Baldwin; Arthur G. Yeager; Michael J. Gilroy

[57] ABSTRACT

A troweling machine having a variable troweling diameter may be constructed by providing such a machine with adjustable length spider arms, an adjustable circumference guard ring, an adjustable length guard ring stabilizer arm and any combination of two of such adjustable features. A universal blade mounting adaptor allows the machine to accept blades of various sized as well as various specific attachment arrangements. A pivotal mount for the guard ring permits it to be swung upwardly from its normal horizontal position.

42 Claims, 14 Drawing Figures

TROWELING MACHINE

BACKGROUND OF THE INVENTION

This invention relates generally to a concrete finishing machine.

As is well known to those skilled in the concrete finishing art, wet concrete, which has been poured into a form such as that used in the construction of floors and the like, is troweled during the hardening period in order to produce a smooth, bubble free surface. During the troweling process, water contained in the wet concrete rises to the surface of the concrete and evaporates therefrom leaving a smooth surface. In addition, such troweling compacts the concrete and increases its strength.

Within approximately the last three decades, mechanized devices for troweling large expanses of concrete have been developed and put into commercial use. Through the use of such machines concrete may be finished at a much more rapid pace and with an increase in the quality and surface smoothness of the finished concrete.

Exemplary of early troweling machines is that disclosed in U.S. Pat. No. 2,594,331 (1952) to McCrery. As is generally disclosed in the McCrery patent, such machines typically comprise a housing, a motor of some type enclosed within the housing, a rotatable shaft connected to the motor and extending vertically downwardly from the housing and a plurality of spider arms extending from the rotatable shaft. Each spider arm carries a troweling blade, which is approximately rectangular having an outer, or distal, end. A guard ring encircles the device outwardly adjacent the outer ends of the blades to prevent any accidental contact with the blades during operation. The guard ring is supported in this position, slightly above the surface of the concrete being troweled, by one or more guard ring stabilizer arms, which are, themselves attached to the housing. A handle extends upwardly and radially from the housing and is equipped with manually operable devices for controlling the machine function.

In operation the motor is actuated and causes the rotatable shaft, and therefore the troweling blades, to rotate. The handle is used by the operator to manipulate the machine in the direction of the wet concrete he wishes to smooth. During the initial stages of the troweling operation while the concrete is still wet, the troweling blades are oriented parallel to the concrete surface in order that the weight of the machine is distributed evenly over their large surface area. As the concrete hardens, however the blades are tilted by the operator such that an increasing portion of the machine weight is borne by the trailing edge of each blade. By so doing the effective pressure (in pounds per square inch) is gradually increased as the hardening of the concrete progresses.

The basic design described hereinabove is still used in modern conventional machines. In addition, it is also known to provide a stabilizer ring which is attached to either the spider arms or to the troweling blades themselves adjacent their outer, or distal, ends. The use of such a stabilizer ring reduces the "wobble" between the blades and increases the efficiency of operation of the machine.

In addition to the patent to McCrery, several patents have issued to inventors for improvements in the blade attaching mechanisms which allow quicker or more efficient removal and replacement of such blades. Exemplary of such patents are U.S. Pat. Nos. 2,667,824 to McCrery, 3,296,946 to Cagno and 3,402,647 to Colizza et al.

Each of the three aforementioned patents attempts to solve the problem of facilitating blade replacement. Nevertheless, there remain greater problems associated with the use of automatic troweling machines. Specifically, these problems arise because certain concrete troweling jobs are more efficiently done with a certain size of troweling machine. For example, a large expanse of concrete such as that found in a large parking garage or warehouse is obviously amenable to being troweled with a troweling machine which has a large troweling diameter, i.e., a large distance between the distal ends of opposite blades. On the other hand, small portions of concrete such as contained in sidewalks, garages, and basemenet floors require a smaller diameter machine in order to enable the operator to avoid obstructions and to fit in tight corners. Finally, small shower or bath rooms and the like are most readily troweled by a machine of still smaller diameter. This need, i.e., for variety of troweling diameters has been met merely by the manufacture of several machines with various troweling diameters.

For this reason, a rental supplier of such machines, or a contractor who owns such machines, must stock a number of each of the various size machines which may be preferred for the various jobs.

In other words since each individual machines is constructed in a fashion similar to that shown in the McCrery reference, i.e. with a fixed diameter guard ring, in order to have "46-inch", a "36-inch" and a "30-inch" troweling capability, one must now own three machines having different diameters of the guard ring and different lengths of the troweling blades.

In addition, due to the lack of standarization in the means used to attach the troweling blades to the spider arms manufactured by the various machine makers, a machine user is restricted in his purchase or replacement troweling blades to the blade type manufactured by the maker of the particular machine involved.

Such blade types include the "bar type" in which the planar blade is bonded to a narrow bar-like backbone which extends for a substantial portion of the length of the blade and which includes means for securing it to the spider arm. Even within the general "bar type" category, individual manufacturers' blades may vary in the width, length or height of the bar as well as in the type and placement of the means for securing the bar to the spider arm. A second general type of blade is the "channel type." This type is characterized by the inclusion of two walls, perpendicular to the blade and parallel to each other, on the top of the blade, which extend for a substantial portion of the length of the blade. These two parallel walls and that portion of the blade top therebetween form a channel. Once again suitable means for securing the channel means to the spider arm are used.

It is accordinally, an object of the present invention to provide a troweling machine which will allow the substitution of various lengths of troweling blades on a single machine.

It is a further object to provide a troweling machine with a variable troweling diameter.

It is a still further object to provide guard rings which are adjustable in diameter and so arranged as to permit ready replacement of different blades and adjustment of troweling diameters.

It is a still further object of this invention to provide a troweling machine which is capable of accepting any of the various troweling blades made by the various blade manufacturers.

SUMMARY

According to the present invention, a troweling machine is provided which allows the use of troweling blades of different lengths and of different mounting types, and which is thereby adapted readily to use on troweling jobs which require different troweling diameters. This is accomplished by the provision of blade mounting adaptors which allow the variance of distance between the blade's outer end and the rotatable shaft. In addition the use of a variable diameter guard ring having at least one slip joint equipped with detent means whereby the ring may be adjusted to, and held, at, any one of a number of different desired diameters, in combination with a plurality of variable length guard ring stabilizer arms will allow the substitution of different sized blades without such adaptor variability. The variable length arms may comprise a telescoping arrangement in combination with detent means for securing the telescoping portions of the arms at positions predetermined to correspond to desired guard ring diameters.

In addition, this variable diameter guard ring is preferable hingedly attached to one of the stabilizer arms in order that the ring may be rotated upwardly and away from the blades to thereby facilitate adjustments to the ring diameter and the lengths of the stabilizer arms and troweling blades. Finally, the machine is equipped with a universal blade mounting adaptor which will accept either bar type or channel type blades in order to adapt to the mounting of the blades of various manufacturers.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DESCRIPTION OF THE PREFERRED EMBODIMENT

A complete understanding of my invention will be gained by those skilled in the art from the following description taken with reference to the drawings.

Figure 1:
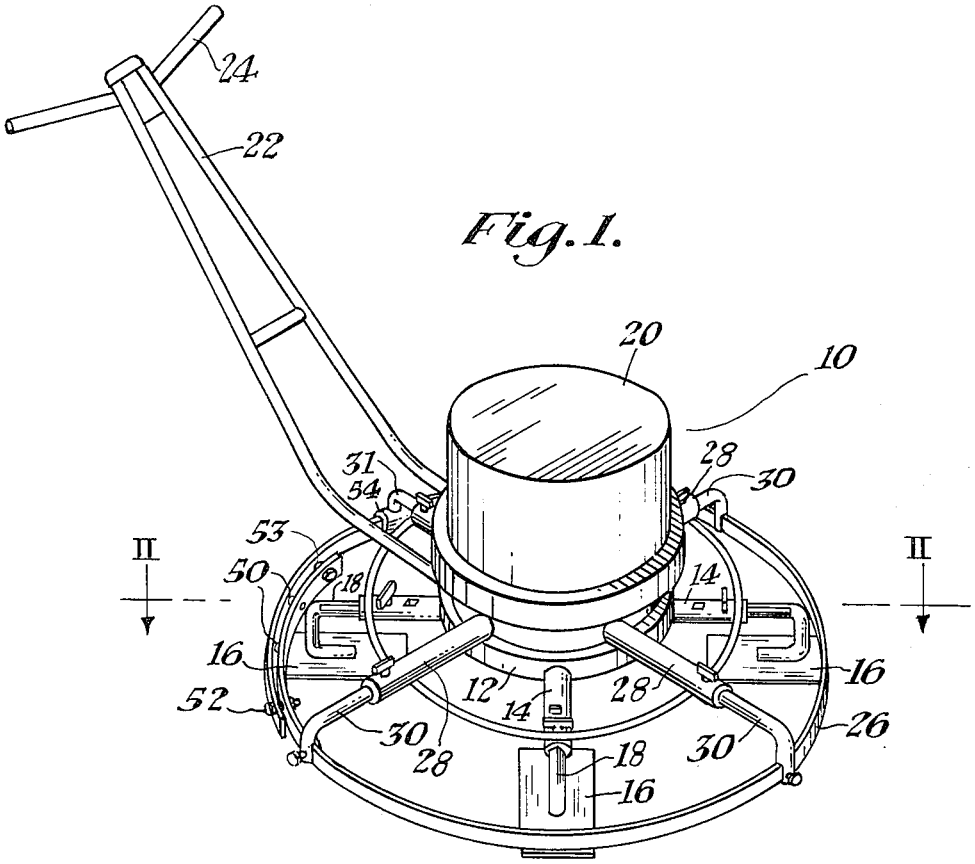
FIG. 1 is a perspective view of an improved concrete troweling machine constructed in accordance with the preferred embodiment of my invention.
Figure 2:
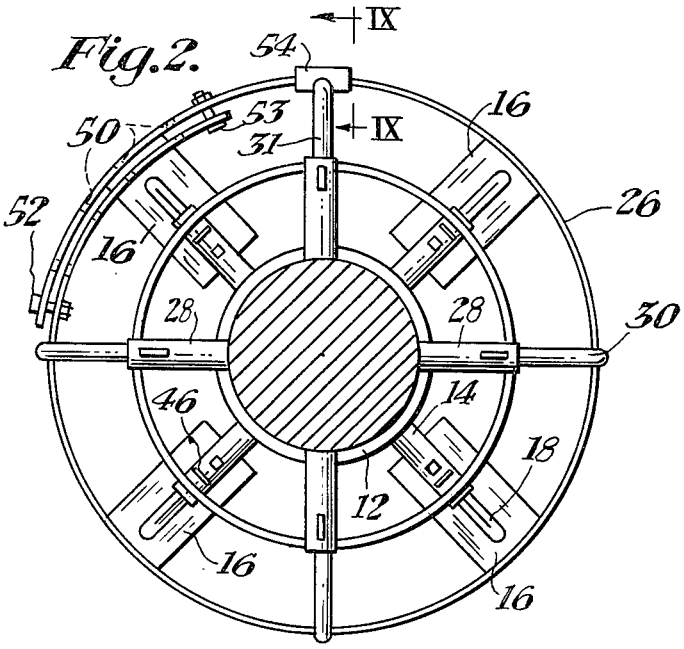
FIG. 2 is a sectional view of my machine taken along line II—II of FIG. 1.

Referring to FIGS. 1 and 2, there is seen a troweling machine constructed in accordance with my invention indicated generally at 10. The apparatus comprises conventional elements such as a rotary base or spider 12, having a plurality of spider arms 14, extending radially therefrom and carrying a plurality of troweling baldes 16, through handles 18 of blade mounting adaptors, described further below. Housing 20 is mounted upon rotary base 12, in axial relation therto, and encloses a motor and associated gear mechanisms. Handle 22, having hand grips 24, is securely attached to, and extends upwardly and outwardly from, housing 20. In addition, guard ring 26 is securely attached to housing 20 by a plurality of guard ring stabilizer arms, having telescoping portions 28 and 30, which extend generally radially from housing 20.

Figure 4A:
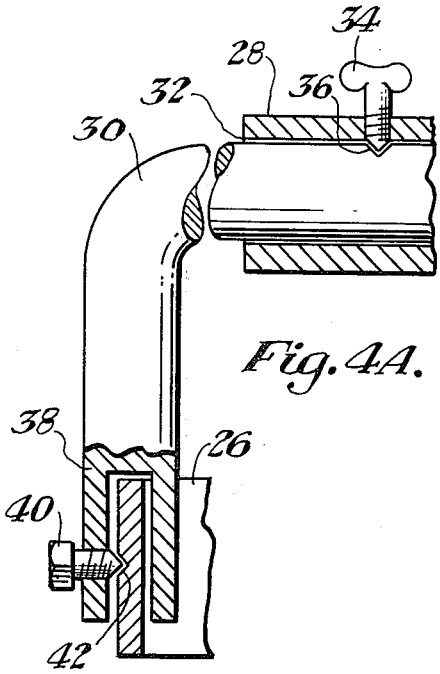
FIG. 4A is a detail view, partly in section, on an enlarged scale showing the stabilizer arm assembly of the apparatus, taken along line IV—IV of FIG. 3.
Figure 3:
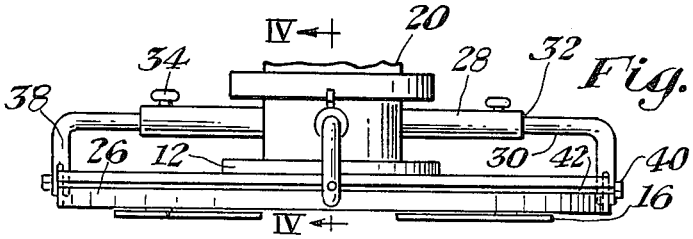
FIG. 3 is a front elevational view of a portion of the apparatus generally corresponding to the portion shown in FIG. 2.

Referring to FIGS. 3 and 4A, the method of assembly of guard ring stabilizer arm portions 28 and 30 is apparent. This assembly comprises a telescoping slip joint 32, which allows solid inner stabilizer arm portion 30 to be slidingly inserted or telescoped into hollow outer stabilizer arm portion 28. By varying the depth of insertion, the resultant distance between the outer end of the stabilizer arm and the housing 20, may be varied over a relatively wide range. Hollow outer stabilizer arm portion 28 has a hole therethrough and is equipped with means for detenting such as detent screw 34. Solid stabilizer arm 30 is equipped with a plurality of compatible detent openings linearly arranged along its length such as a series of sockets 36, which correspond to the conformation of screw 34. This plurality of indentations in solid arm, 30 will allow adjustment of the length of the stabilizer arm.

Guard ring 26, is maintained at any desired diameter by releasable guard ring securing means attached to the end of solid stabilizer arm 30. The holding means shown in FIG, 4A comprises an inverted U-shaped joint 38, screw means 40, and compatible groove 42 in guard ring 26.

Figure 4B:
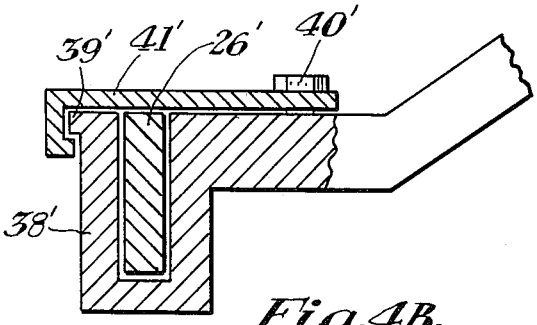
FIGS. 4B and 4C are partial sectional views similar to FIG. 4A but showing alternative exbodiments of the guard ring securing means of the stabilizer arm assembly shown in FIG. 4A.
Figure 4C:
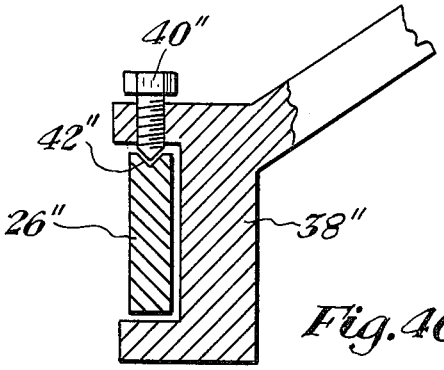

FIGS. 4B and 4C disclose alternative constructions for the guard ring securing means of the stabilizer arms. In FIG. 4B, guard ring 26' is rested in, and partially enclosed by, U-shaped portion 38', having a lip 39', on its outer edge. A lid 41', having a lip-engaging distal end may then be placed atop the U-shaped member and secured in place by suitable means such as screw 40'.

In a second alternative embodiment, shown in FIG. 4C, a reverse-C shaped member 38" is used which partially encloses guard ring 26". As with the embodiment shown in FIG. 4A, suitable screw means 40", and groove means 42", may be used to secure the ring 26" in the member 38". Rings 26' and 26" are, except as noted, generally similar to ring 26.

Figure 5:
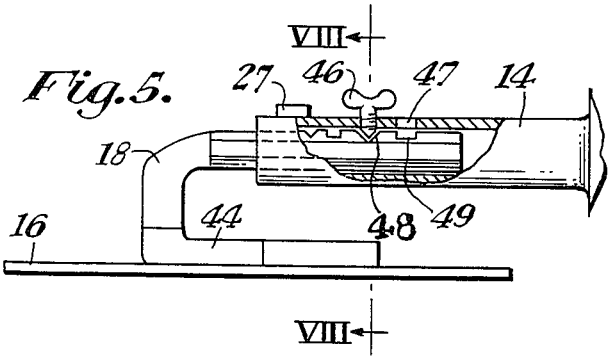
FIG. 5 is a detail elevational side view of a spider arm and an associated troweling blade of a machine constructed in accordance with my invention.
Figure 7:
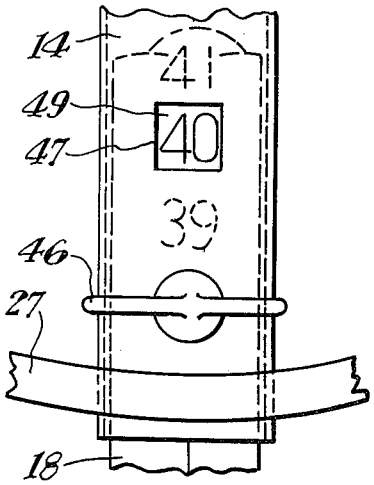
FIG. 7 is a top view of the spider arm and troweling blade interlocking mechanism portions of the machine on an enlarged scale.
Figure 8:
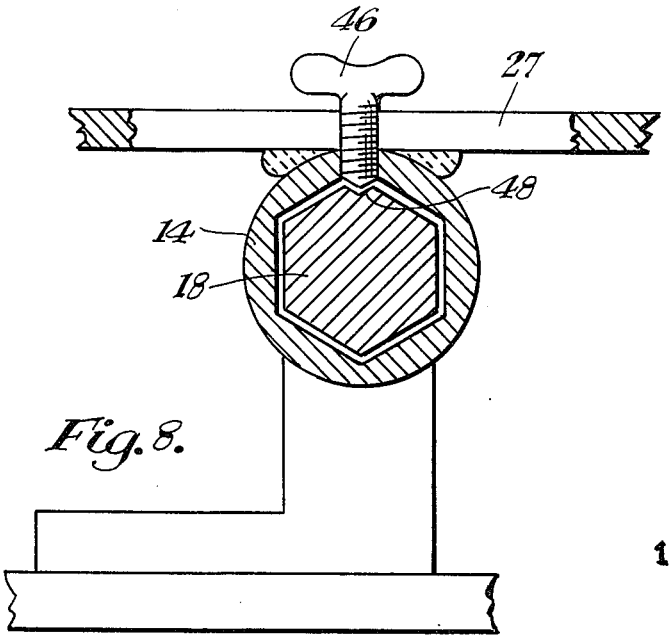
FIG. 8 is a sectional view of the spider arm taken along line VII—VIII of FIG. 5.

FIG. 5 shows an individual troweling blade 16, spider arm 14, troweling blade mounting adaptor 44 and handle 18. Handle 18 is slidingly inserted in hollow spider arm 14 to the desired depth. Once at the desired depth in spider arm 14, handle 18 is locked in place by detent means such as wing screw 46, which is threadedly inserted in a threaded hole in spider arm 14. As can be seen from the sectional view shown in FIG. 8, a similar arrangement may be used to lock the handle into position in the spider arm as is used to lock the inner solid stabilizer arm portion in the outer hollow stabilizer arm portion at the desired length. This comprises a wing screw 46 and a matching indentation 48 in the handle. FIG. 8 shows the handle 18 and the spider arm interior to be generally hexagonal in cross-section in order to prevent rotation of the handle within spider arm 14. Finally, as shown in FIGS. 5, 7, and 8, a stabilizer ring 27 may be attached to each spider arm 14 at or immediately adjacent the outer end thereof. By so doing, the troweling blade assembly may be stabilized without interfering with the ease of substitution of one set of troweling blades for another As shown in FIG. 7, spider arm 14 may be provided with a window 47 which will display specific numbers, such as the number "40" shown, when a particular indentation 48 in handle 18 is engaged. Such numbers may be engraved in handle 18 on "flats" 49. By preselecting the numbers shown in window 48 to correspond to the troweling diameter the operator may be enabled to tell at a glance how wide a sweep may be obtained using that particular setting on the troweling blade mount-spider arm.

Figure 6:
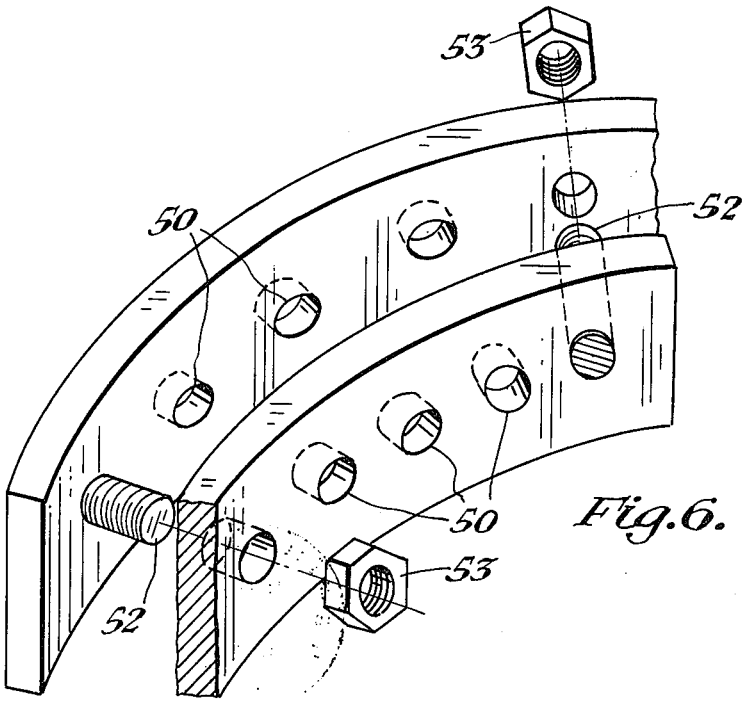
FIG. 6 is an exploded perspective view on the scale of FIG. 4 showing end portions of the blade guard ring of the machine.

FIG. 2 shows guard ring 26 as an elongated belt, the opposite ends of which have been brought adjacent to each other thereby forming the circular guard ring. Each end is equipped with means for releasable attachment of itself to the other end in selected adjustable position. Such means may comprise a detent means, such as an inwardly biasable cylindrical shaft which is insertable through holes in both ends or may comprise a threaded bolt used in conjunction with a series of compatibly threaded holes in each end of the belt. Any such detent means may be used either with the ends adjacent to each other or with one of the ends being solid and insertable into a hollow second end. In the preferred embodiment, as shown in FIG. 6, such means may comprise a series of eyelet holes 50 used in conjunction with securing bolts 52 and nuts 53 which allow the guard ring to assume any one of several different circumferences.

While each of the stabilizer arms may be constructed so as to hold guard ring 26 as shown in FIGS. 4A, 4B, or 4C, it is preferred, that one of the attaching means be attached to the guard ring such that the ring itself may be rotated about that point out of the troweling plane defined by the troweling blades. One such arrangement is shown in FIGS. 2 and 9.

Figure 9:
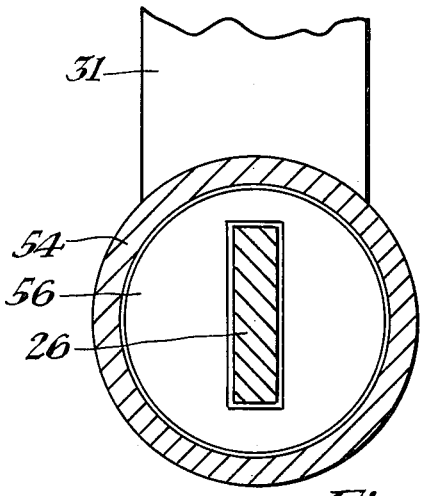
FIG. 9 is a sectional view showing the rotatable guard ring holding assembly on the scale of FIG. 4 taken along line IX—IX of FIG. 2.

Referring to FIGS. 2 and 9, the rearward projecting solid stabilizer arm 31, is equipped with circular guard ring holder head 54 having a hollow center in which rotatable guard ring holder 56 is rotatably mounted. Holder 56 has a hollow center adapted to enclose a portion of guard ring 26 and to rotatably support guard ring 26 in holder head 54.

While the preferred embodiment of my invention, as shown in FIGS. 1-9, comprises three adjustable elements i.e. guard ring circumference, stabilizer arm length, and troweling blade-to-rotatable shaft distance, it has been found that the use of any two of these adjustable elements in combination with a non-adjustable third element, will accomplish the basic objective of my invention, i.e. to provide a variable diameter troweling machine. Thus, having an adjustable blade/shaft distance and an adjustable guard ring stabilizer arm will accomplish the objective when used in conjunction with a plurality of fixed circumference guard rings of various sizes. Similarly, a plurality of sets of troweling blades, each set having different sized blades, when used in combination with an adjustable circumference guard ring and an adjustable length stabilizer arm will do so. Finally, using a set length stabilizer arm in conjunction with a variable circumference guard ring and a variable blade/shaft distance, will do so.

The troweling apparatus according to this invention is, thus, capable of accomplishing the basic object of the invention in a variety of embodiments as well as in a preferred embodiment. However, since each manufacturer of troweling machines makes troweling blades which are compatible only with its machines, substitution of the blade of one manufacturer on the machine of another manufacturer is virtually impossible. For this reason, the universal blade mounting adaptor 44 shown in FIGS. 10, 11, and 12 is preferrably used in combination with my variable diameter troweling apparatus in order than its full utility may be reached.

Figure 10:
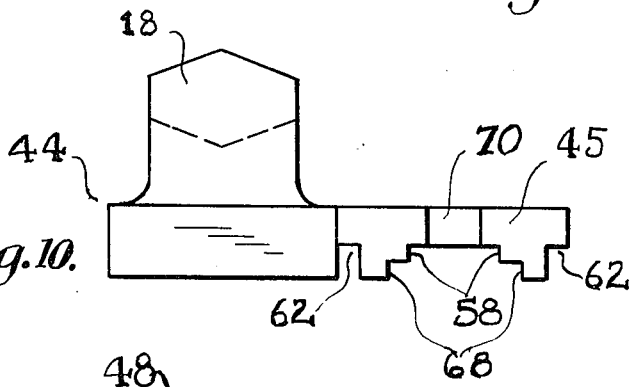
FIG. 10 is a front elevational view of a spider arm element constructed in accordance with a modified embodiment of my invention.
Figure 11:
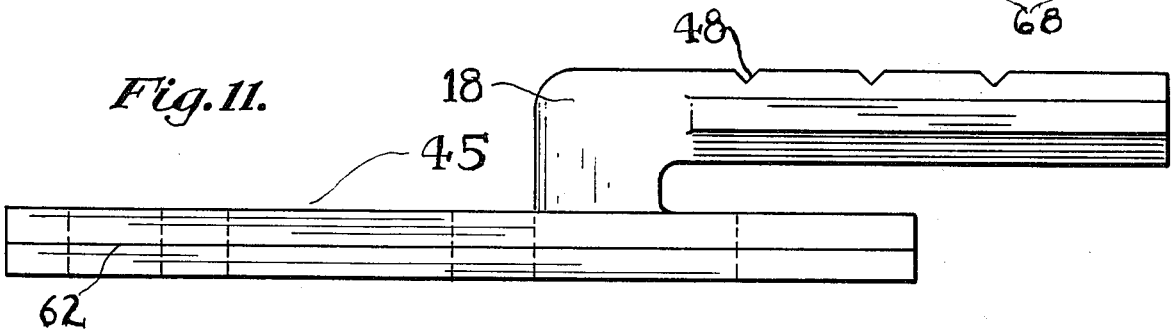
FIG. 11 is a side view of the element shown in FIG. 10.
Figure 12:
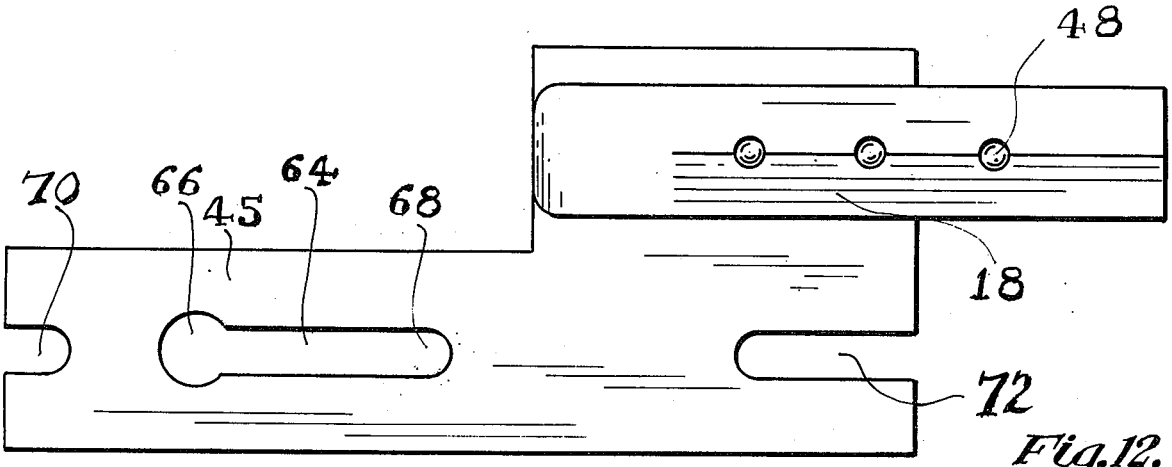
FIG. 12 is a top view of the element shown in FIGS. 10 and 11.

Referring to FIGS. 10, 11, and 12, there is seen a universal blade mounting adaptor 44 comprising a blade securing portion 45 and a handle 18 attached, and extending parallel, thereto. Blade securing portion 45 may have one or more longitudinal grooves of various widths such as those shown at 58 and 60, extending the length thereof. In addition, a pair of lateral grooves 62 may be extended substantially the length of portion 44. As shown in FIG. 12, portion 44 has a central cylindrical slot 64 extending vertically therethrough. Slot 64 has a distal end 66 which is circular and has a diameter greater than the width of the cylindrical slot, and proximal end 68 which is semi-circular having a diameter equal to the slot width.

In addition, portion 45 is equipped with a distal truncated slot 70 and a proximal truncated slot 72 extending vertically therethrough, each of which terminates in adaptor 44 in a semi-circular end of diameter equal to their width. As is shown in FIG. 10, slot 70 and, indeed slots 64 and 72, are all centered with respect to channels 58, 60, and 62.

In the preferred embodiment of my adaptor, adaptor 44 is 7 inches in length, slots 70, 64, and 72 are three-eighths of an inch in width, distal end 66 has a diameter of nine-sixteenths of an inch, distal truncated slot 70 extends one-half inch into adaptor 44, proximal truncated slot 72 extends $1\frac{3}{8}$ inch into adaptor 44 and the inner end of slot 70 is one inch from the center of end 66. In addition, in my preferred adaptor groove 58 is $\frac{5}{8}$ inch in width, groove 60 is seven-eighths inch in width and the distance between lateral grooves 62 is 1.218 inches, with each such groove being 0.141 inch wide. Finally, groove 58 is preferably one-fourth of an inch in depth while channel 60 is one-eighth of an inch in depth.

While I have shown my blade mounting adaptor as having a hexagonal cross-section handle 18 which is inserted into a hollow spider arm, it is equally feasible, in the absence of stabilizer ring 27, that a cylindrical receptacle portion may be affixed to adaptor 44 and a solid spider arm may extend from the shaft for insertion in blade's receptacle. Either embodiment may be used without hindering the use of my invention. Finally, handle 18 is shown as hexagonal and as having a plurality of indentations 48 as disclosed earlier in FIG. 8.

In use, adaptor 44 will be capable of accepting both a bar type blade (by insertion of the bar in longitudinal grooves 58 or 60) or a channel type blade (by placing that portion of the adaptor which lies between lateral grooves 62 interiorly of the parallel walls of the channel blade). The various cylindrical and truncated slots are sized and positioned to be compatible with the various adaptor securing means, such as bolts, wing screws or the like, which extend therethrough, to secure the blade 16 to the adaptor. By using an adaptor as disclosed above, my improved troweling machine will be compatible with all types of blades currently manufactured.

Having described each aspect of the preferred and modified embodiments of my invention, the operation thereof will be understood from the following discussion.

As with conventional troweling machines actuation of the motor of my machine will, through gears enclosed in housing 20 cause a rotatable shaft to turn and rotary base 12 to rotate thereby rotating blades 16 through a troweling diameter. By application of pressure to handle 22 through hand grips 24, an operator may direct the troweling machine over the desired areas of the concrete.

If a larger or smaller troweling diameter than that to which the machine has been set is desired, the operator would deactivate the motor and loosen each screw 40 in each of the several stabilizer arms 30 in order to disengage those arms from guard ring 26. The operator would then loosen wing nuts 34 in hollow stabilizer arms 28, thereby allowing solid stabilizer arm 30 to be telescopingly inserted into hollow arm 28 and inwardly from the ring 26. Having accomplished that, guard ring 26 may be swung upwardly away from the concrete surface about rotatable guard ring holder 56 within head 54. With the ring so swung upwardly out of the way, troweling blades 16 may be replaced by loosing wing screws 46 and removing handles 18 from hollow spider arms 14. Alternatively, blades 16 may be removed from blade mounting adaptor 44 without removing handle 18. As is seen, removal of either handle or adaptor may be accomplished without disturbing stabilizer ring 27. A new set of troweling blades may then be attached to the machine. Once each new troweling blade has been locked at the desired length with wing nut 46, its orientation and length may be checked by reference to window 48 which will expose flat 49 displaying similar figures for each spider arm. Having replaced troweling blades 16 with new troweling blades the operator may then adjust the circumference of guard ring 26 and secure the new circumference by the use of guard ring securing means such as eyelet holes 50, securing bolts 52, and nuts 53 shown in FIGS. 2 and 6. Once the circumference has been adjusted and the securing means set, guard ring 26 may be rotated downwardly to its original position adjacent the concrete, and the guard ring stabilizer arms 30 may be extended outwardly to a position adjacent ring 26 and inverted U-shaped member 38 positioned about the ring to secure and stabilize it. Having adjusted the length of stabilizer arms 28 and 30, wing nuts 34 and 46 are tightened into the appropriate grooves 36 and 48 respectively in order to maintain the guard ring's stability.

By utilizing my invention as herein above described, the necessity of owning a plurality of troweling machines and a plurality of troweling blades of different manufacturers in order to have the various diameter troweling capabilities is obviated. One now need only own one troweling machine and a series of various size troweling blades all of which are interchangeable with that machine.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to be secured by Letters Patent of the United States is:

1. In a troweling machine having a housing, a rotatable shaft extending downwardly therefrom, a plurality of troweling blades having outer ends, means for mounting said blades to said shaft, guard means for shielding the outer ends of said blades from contact with obstacles, a stabilizer arm connecting said guard means to said housing, the improvement comprising, in combination, said mounting means including adjustable means for adjusting the distance between said shaft and the outer ends of said blades, and said stabilizer arm including length adjusting means for adjusting the distance between said shaft and said guard means.

2. The combination as set forth in claim 1 wherein there are a plurality of such stabilizer arms, each provided with such adjusting means.

3. The combination as set forth in claim 2 wherein said guard means comprises a plurality of arcuate circular sections respectively attached to each of said plurality of stabilizer arms.

4. The combination as set forth in claim 1 wherein said guard means is a fixed diameter ring having a diameter compatible for use with a specific adjustment on said adjustable means for adjusting the distance between said rotatable shaft and said outer ends

5. In a troweling machine having a housing, a rotatable shaft extending downwardly therefrom, a guard ring having a circumference and a stabilizer arm connecting said guard ring to said housing, in combination, said stabilizer arm including length adjusting means for adjusting the distance between said shaft and said guard ring and said guard ring including adjustable means for adjusting the circumference of said guard ring.

6. In a troweling machine having a housing, a rotatable shaft extending downwardly therefrom, a plurality of troweling blades having outer ends, means for mounting said blades to said shaft, a guard ring for shielding the outer ends of said blades from contact with obstacles, said guard ring having a circumference, a stabilizer arm connecting said guard ring to said housing, the improvement comprising, in combination, said mounting means including adjustable means for adjusting the distance between said shaft and the outer ends of said blades, and said guard ring including adjustable means for adjusting the circumference of said guard ring.

7. In a troweling machine having a housing, a rotatable shaft extending downwardly therefrom, a plurality of troweling blades having outer ends, means for mounting said troweling blades to said shaft, a guard ring for shielding the outer ends of said blades from contact with obstacles, said guard ring having a circumference, a stabilizer arm connecting said guard ring to said housing, the improvement comprising, in combination, said mounting means including adjustable means for adjusting the distance between said shaft and the outer ends of said blades, said stabilizer arm including length adjusting means for adjusting the distance between said shaft and said guard means, and said guard ring including adjustable means for adjusting the circumference of said guard ring.

8. The combination as set forth in claim 7 wherein said means for mounting comprises a plurality of spider arms connected to, and extending radially from, said rotatable shaft and a plurality of blade mounting adaptor means for releasably connecting said troweling blades to said spider arms.

9. The combination as set forth in claim 8 wherein each one of said blade mounting adaptor means comprises a generally planar, blade securing portion and an elongated handle portion connected thereto, and extending parallel to, and above, said planar portion, for connecting said blade securing portion to said spider arm.

10. The combination as set forth in claim 9 wherein the elongated handle portion of said adaptor means is hexagonal in cross-section and wherein said spider arm is generally cylindrical and has an annular activity compatible with said hexagonal handle and adapted to securingly accept the insertion of said handle.

11. The combination as set forth in claim 10 wherein said hexagonal handle portion and the compatible annular cavity of said spider arm are each of sufficient length to allow the insertion to be varied over a range of depths.

12. The combination as set forth in claim 11 wherein said spider arm has a threaded hole therein, said hole extending into said cavity and wherein said means for adjusting the distance between the rotatable shaft and the outer ends of said blades comprises:

a. a screw means adjustably insertable into the cavity of said spider arm through said threaded hole in said spider arm, and b. a plurality of indentations in said handle in linearly spaced relation to each other along a portion of the length of said handle, and each said indentation registerable with the hole in said spider arm and sized compatible with the insertion of said screw means, so constructed and arranged that the depth of insertion of said handle in the cavity of said spider may be adjusted to a predetermined value, and may be releasably held at such depth by insertion of said screw means through said hole and into securing contact with one of said indentations placed in register therewith.

13. The combination as set forth in claim 12 wherein each said spider arm has a window therein and each said mounting adaptor handle portion has a series of flats, each said flat having individual indicia thereon, located linearly along a portion of said handle and registerable with said window, so constructed and arranged that the selection of an individual handle insertion depth will expose a specific flat in said window, said flat displaying a specific indicia.

14. The combination as set forth in claim 12 wherein said stabilizer arm comprises a hollow outer portion having a proximal end attached to said housing and a distal end, and a solid inner portion having a proximal end and a distal end, said distal end attached to said guard ring, said proximal end of said solid inner portion being slidably insertable into said hollow outer portion through an opening in the distal end of said outer portion, wherein said hollow outer portion has a hole therein communicating with the interior thereof and wherein the means for adjusting the length of said stabilizer arm comprises a detent means slidably insertable through said hole into the interior of the hollow outer portion, so constructed and arranged that the insertion of said detent means will securingly engage said solid inner portion at a desired depth of insertion in the hollow outer portion.

15. The combination as set forth in claim 14 additionally comprising a plurality of indentations linearly arranged along the solid inner portion and adjustably registerable with said hole, said indentations being so sized to accept a portion of said detent means therein.

16. The combination as set forth in claim 15 wherein said detent means comprises a cylindrical shaft having a top end and a bottom end and a biasing means, said biasing means connecting said top end of said shaft to said outer portion and exerting a force on said shaft so as to force the bottom end of said shaft through said hole in said outer portion and into one of said indentations.

17. The combination as set forth in claim 15 wherein said hole is threaded and said detent means is a compatibly threaded shaft of sufficient length to be threadedly inserted into said hole and into contact with one of said indentations.

18. The combination as set forth in claim 17 wherein said guard ring comprises an elongated belt, said belt having a first end and a second end, said second end being releasably held adjacent to said first end so as to form a circular ring.

19. The combination as set forth in claim 18 wherein said adjustable means for adjusting the circumference of the guard ring comprises holding means connected to said first end and acceptor means, compatible with said holding means, in at least said second end.

20. The combination as set forth in claim 19 wherein said first end and said second end each have acceptor means which comprise a plurality of holes therein which holes are arranged linearly along said ends and each hole in said first end is registerable with each hole in said second end, and wherein said holding means comprises at least a first cylindrical member sized to be positionable through said holes, so constructed and arranged that insertion of said cylindrical member through one hole in said first end and one hole in said second end will fix the circumference of said guard ring.

21. The combination as set forth in claim 20 wherein said first end has a cavity extending from an opening in said first end to a point along its length and wherein said second end is so sized and shaped as to be insertable into said cavity along a portion of its length.

22. The combination as set forth in claim 20 additionally comprising biasing means attached to said first end and to said first cylindrical member for holding said member in position inserted through the holes in said first and second ends.

23. The combination as set forth in claim 20 wherein said first cylindrical member is threaded and each said hole has a thread compatible with the said member 24. The combination as set forth in claim 20 wherein said first cylindrical member has a top end and a bottom end and wherein said top end is permanently attached to said first end of said belt and so arranged with respect thereto as to allow the bottom end thereof to be insertable through any one of the holes in the second end of said belt and wherein the sides of said member adjacent the bottom end of said member are threaded, and additionally comprising at least a first nut, having a thread compatible with that of said member, so constructed and arranged that the bottom end of said threaded member may be inserted through a hole in said second end and said first nut threadedly engaged with said member to prevent the withdrawal of said member from said hole.

25. The combination as set forth in claim 24 additionally comprising a second cylindrical member, having a top end and a bottom end, said top end permanently attached to the second end of said belt and so arranged with respect thereto as to allow the bottom end thereof to be insertable through any one of the holes in the first end of said belt, and wherein the portion of said second member adjacent said bottom end has a thread and is sized so as to be insertable through any one of said holes in said first end, and a second nut having a thread compatible with the thread of said second member, so constructed and arranged that said first member and said second member will insert into holes in register therewith in said second end and said first end respectively, and will be releasably secured therein by the engagement of said first and second nuts with said first and second members respectively, thereby determining the circumference of said ring.

26. The combination as set forth in claim 25 additionally comprising a releasable guard ring securing means, rotatably connecting said guard ring to said stabilizer arm, so constructed and arranged that said guard ring may be rotated upwardly away from said troweling blades about said securing means.

27. The combination as set forth in claim 26 wherein said securing means comprises a hollow outer cylinder, attached to said stabilizer arm, and an inner cylinder having an axial cavity therein for holding a portion of said guard ring, said inner cylinder being rotatably mounted within said outer cylinder about its axis.

28. In a troweling machine having a housing, a rotatable shaft extending downwardly therefrom, a plurality of troweling blades, each said troweling blade having an inner end and an outer end, and means for mounting said blades to said shaft, said mounting means including, in combination, adjustable means for adjusting the distance between said shaft and the outer ends of said blades; and a plurality of troweling blade mounting adaptors, each said adaptor having a blade securing portion and a handle portion, so constructed and arranged that said blade securing portion is releasably attachable to both bar-type and channel-type troweling blades irrespective of the distance from the inner edge to the outer edge thereof.

29. A universal blade mounting adaptor for releasably attaching a troweling blade to a spider arm of an automatic troweling machine said blade having an upper side with means for securing said blade to said adaptor thereon, comprising:

a. a blade securing portion having a proximal end, a distal end, an upwardly oriented side and a downwardly oriented side and having a longitudinal groove in said downwardly oriented side, said groove being of sufficient length, width and depth to accept a bar-type means for securing; and having a pair of lateral grooves in said downwardly oriented side, said pair being parallel to said longitudinal groove and of sufficient length, width and depth and having sufficient distance between said pair to accept a channel-type means for securing; and having a plurality of holes extending vertically through said blade securing portion disposed along the length of said longitudinal groove and equi-distantly between said pair of lateral grooves, said holes being oriented to extend between the downwardly oriented side and the upwardly oriented side and sized and spaced from each other so as to allow a portion of said means for securing to extend therethrough, and b. a handle, attached to the upwardly oriented side of said blade securing portion and adapted to be releasably connected to said spider arm.

30. A universal blade mounting adaptor as set forth in claim 29 having a plurality of longitudinal grooves each said groove having parallel vertical walls and each said groove differing from each other said groove in the width thereof.

31. A universal blade mounting adaptor as set forth in claim 30 wherein said plurality of longitudinal grooves are superimposed upon one another with the depth of each said groove varying inversely with the width thereof.

32. A universal blade mounting adaptor as set forth in claim 31 wherein one of said pair of lateral grooves is disposed equidistantly on either side of said longitudinal grooves.

33. A universal blade mounting adaptor as set forth in claim 32 wherein said plurality of holes are centered with respect to said longitudinal grooves and intersect perpendicularly therewith.

34. A universal blade mounting adaptor as set forth in claim 33 wherein said plurality of holes comprise a proximal truncated slot, a central cylindrical slot and a distal truncated slot.

35. A universal blade mounting adaptor as set forth in claim 34 wherein said adaptor is seven inches in length and said proximal truncated slot has parallel sides spaced three-eights inches from each other and extending one and three-sixteenths inches into said adaptor and wherein said proximal truncated slot is terminated by a semi-circular end having a diameter of three-eights inches.

36. A universal blade mounting adaptor as set forth in claim 35 wherein said distal truncated slot has parallel sides spaced three-eights inches from each other and extending five-sixteenths inches into said adaptor and wherein said distal truncated slot is terminated by a semi-circular end having a diameter of three-eights inches.

37. The universal blade mounting adaptor as set forth in claim 36 wherein said central cylindrical slot has a semi-circular proximal end with a diamter of three-eights inches located a distance of two and three-sixteenths inches from said proximal truncated slot, and has a distal end comprising a circular portion having a diameter of nine-sixteenths inch and having the center of said circular portion located one inch from the semi-circular end of the distal truncated slot, and has two parallel sides spaced three-eighths inch from each other extending from the semi-circular proximal end to a point of intersection with said distal end circular portion.

38. The universal blade mounting adaptor as set forth in claim 37 wherein said plurality of longitudinal grooves comprise a first groove having a width of five-eighths inch, a depth of one-fourth inch and length of seven inches and a second groove having a width of seven-eighths inch a depth of one-eighth inch and a length of seven inches.

39. The universal blade mounting adaptor as set forth in claim 38 wherein said pair of lateral grooves comprises two grooves each having a width of one hundred forty one thousandths inch, a depth of one fourth inch, a length of seven inches and a distance therebetween of one and two hundred eighteen thousandths inches.

40. The universal blade mounting adaptor as set forth in claim 39 wherein said handle is attached to the upwardly oriented side of said blade securing portion at a point thereon remove from said slots

41. The universal blade mounting adaptor as set forth in claim 40 wherein said handle is hexagonal in cross-section and has a plurality of indentations compatible with a means for detenting mounted on said spider arm.

42. The combination as set forth in claim 7 wherein said stabilizer arm includes a releasable means for securing said guard ring to said stabilizer arm.

* * * * *